United States Patent [19]

Shank

[11] 4,452,223

[45] Jun. 5, 1984

[54] CYLINDRICAL GRINDING MACHINE TRUING AND DRESSING DEVICE

[75] Inventor: William E. Shank, Waynesboro, Pa.

[73] Assignee: Litton Industrial Products, Inc., Waynesboro, Pa.

[21] Appl. No.: 414,847

[22] Filed: Sep. 3, 1982

[51] Int. Cl.[3] ..... B24B 53/04

[52] U.S. Cl. ..... 125/11 R; 51/161; 51/263; 51/166 TS; 125/11 CD

[58] Field of Search ..... 51/166 TS, 67, 161, 51/168, 263; 125/11 R, 11 CD

[56] References Cited

U.S. PATENT DOCUMENTS

| | | | |
|---|---|---|---|
| 2,337,183 | 12/1943 | Canning | 51/161 |
| 2,406,606 | 8/1946 | Jackson | 125/11 R |
| 2,782,575 | 2/1957 | Housdorfer | 51/263 |
| 2,926,651 | 3/1960 | Balsger | 125/11 CD |
| 4,182,082 | 1/1980 | Meyer | 125/11 CD |

*Primary Examiner*—Harold D. Whitehead
*Attorney, Agent, or Firm*—Spencer T. Smith

[57] ABSTRACT

A cylindrical grinding machine truing and dressing device for refinishing the surface of a peripheral grinding wheel of a cylindrical grinder comprising support base attached to the work bed of a cylindrical grinding machine, housing means mounted to the base having means for rotatably supporting rotatable truing tool means, means for slidably housing dressing bar and abrasive block means, motor drive means to rotatively power the truing tool means, timing belt means to transmit rotative power to the truing tool means, stepping motor means to axially displace the dressing bar and abrasive block means, worm gear means for translating the stepping motor rotation into dressing bar axial displacement, the axial displacement precisely controlled to forcefully engage grinding wheel before, during and after truing operation.

5 Claims, 4 Drawing Figures

CYLINDRICAL GRINDING MACHINE TRUING AND DRESSING DEVICE

BACKGROUND AND OBJECTS OF THE INVENTION

This invention describes a device which combines the truing and dressing operations to refinish the surface of a peripheral grinding wheel of a cylindrical grinding machine with precise parallel tolerances when the grinder utilizes a Cubic Boron Nitride (CBN) grinding wheel.

Previous art has required either sequentially dressing and truing or, where combined, employing complex apparatus to dirve dressing and truing wheels each operating at different speeds relative to the grinding wheel.

It is evident that it would be desirable to carry out both operations in a single step while at the same time performing the operations with simple, economic equipment.

In the present invention, the truing and dressing device provides for dressing the grinding wheel to restore its geometric configuration to the original shape, truing for sharpening the wheel and a final dressing to remove any glazing and to remove a small layer of matrix bond to expose sharp particles of the CBN grinding wheel all in a single step. A dressing bar having an abrasive block is used in combination with a rotary diamond truing tool to obtain precise parallel to tolerances of the surface finish of the grinding wheel.

It is, therefore, an object of the invention to provide a cylindrical grinding machine truing and dressing device.

It is also an object of the invention to provide a truing and dressing device which performs both operations in a single step.

It is further an object of the invention to provide a device which utilizes simple, economic and easily replaced abrasive blocks for dressing.

It is further an object of the invention to provide a device which continuously and accurately advances the abrasive block throughout the dressing operation.

Additional objects and advantages of the invention will be best understood from the following description of specific embodiments when read in connection with the accompanying drawing.

DESCRIPTION OF THE PREFERRED EMBODIMENT

Figure 1:
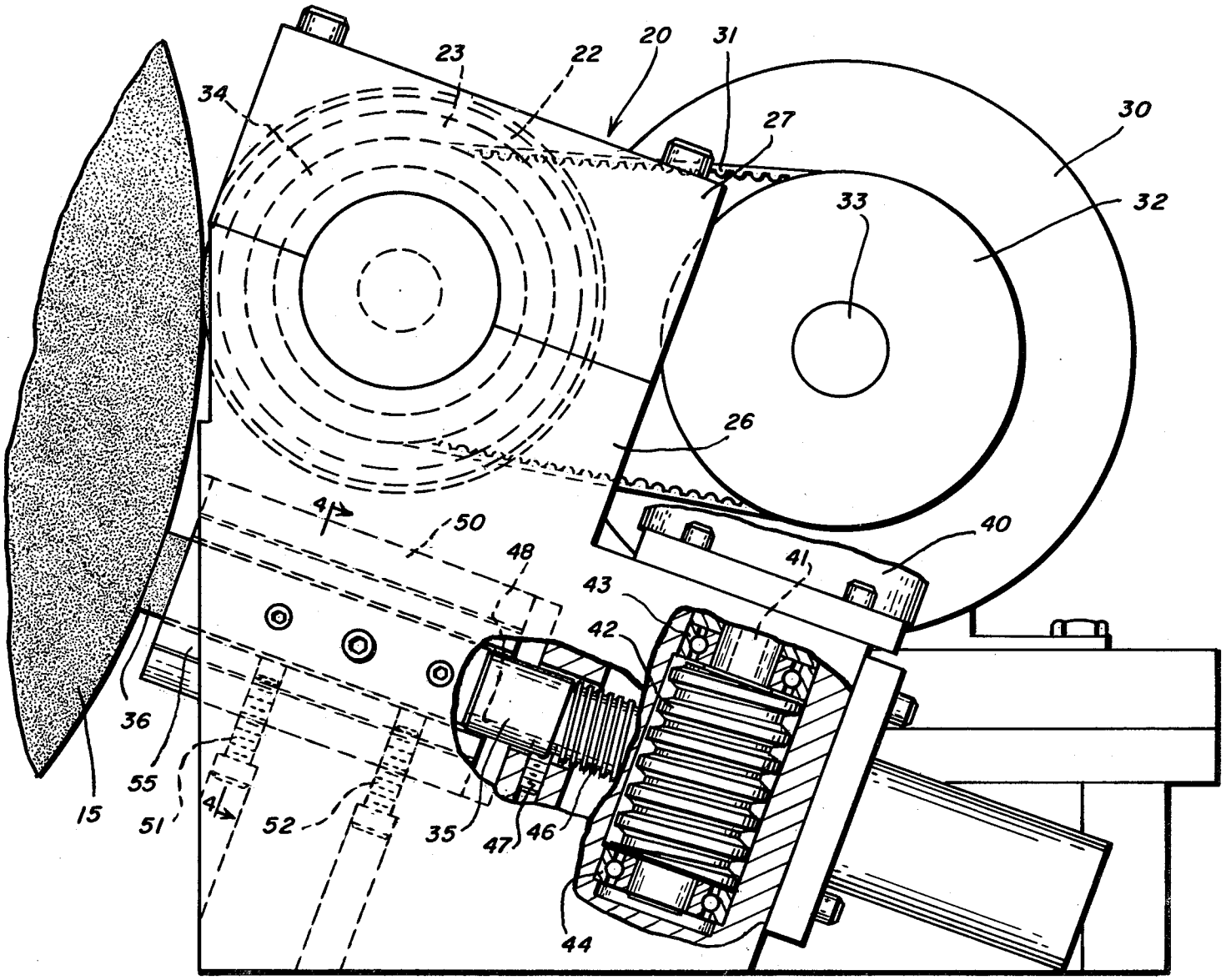
FIG. 1 is a side view of the grinding machine truing and dressing device.
Figure 2:
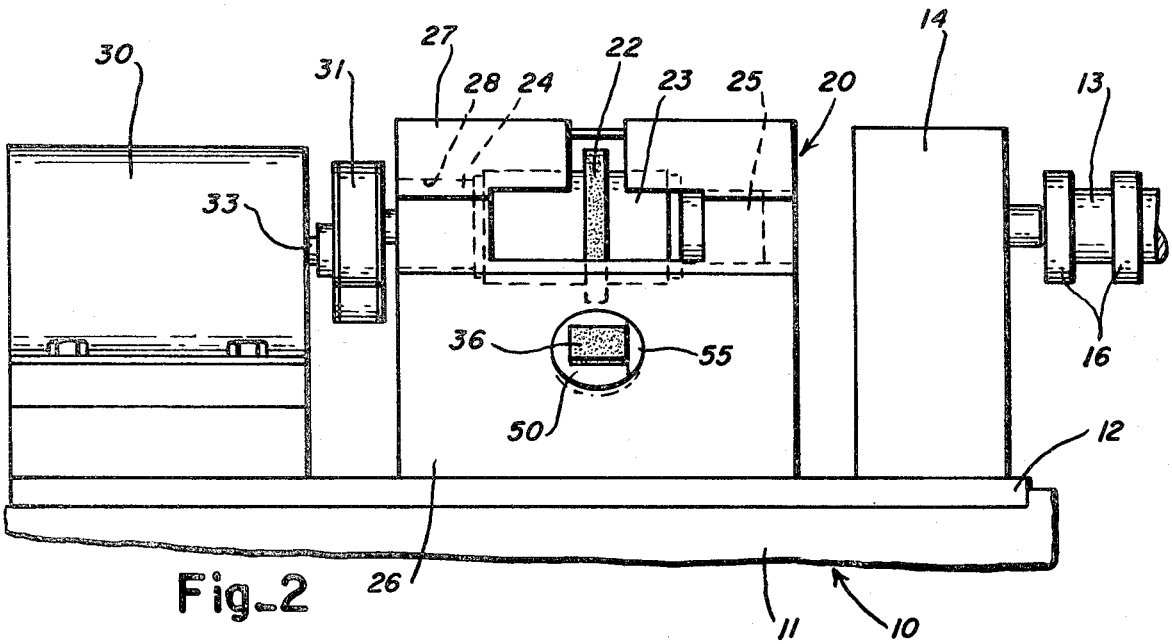
FIG. 2 is a front view of the truing and dressing device shown in FIG. 1.

Referring to FIGS. 1 and 2, a cylindrical grinding machine 10 includes a bed 11 slidably supporting a work table 12. A workpiece 13 is supported between a headstock (not shown) and a footstock 14 which are secured to the work table 12. A grinding wheel 15 is rotatably mounted on a wheelhead support member (not shown) that is advanced in accordance with a predetermined infeed program to effect a grinding operation on one or a plurality of workpiece portions 16.

The grinding wheel 15 is composed of abrasive grain particles of hard material such as Cubic Boron Nitride (CBN) that are bonded to the wheel with resins or other bond or matrix material. The grinding wheel is advanced after the work table 12 is indexed axially to the workpiece portions 16.

A dressing and truing assembly 20 carried by the work table 12 is provided to restore the peripheral surface of the grinding wheel 15 to a precise parallel relationship to the workpiece axis. The dressing and truing mechanism 20 includes a rotary truing tool 22 having impregnated diamonds to provide a continuous truing action when the truing tool 22 is rotated. The truing tool 22 is formed on a hardened steel mandrel 23 which is rotatably supported in spaced bearings 24 and 25 and secured to the base 26 by a cap member 27. The bearings 24 and 25 are mounted and sealed within the bore 28 of the dresser base 26 to prevent contamination from coolant and air-borne particles.

The dresser base 26 is secured to the work table 12 and is longitudinally positioned in axial alignment with the grinding wheel 15 prior to a dressing operation. The rotary truing tool 22 is driven by an electric motor 30 which is coupled to the mandrel 23 by a timing belt 31 which connects the motor sprocket 32 that is keyed to the motor shaft 33 and the spindle sprocket 34 that is secured to the mandrel 23.

Figure 3:
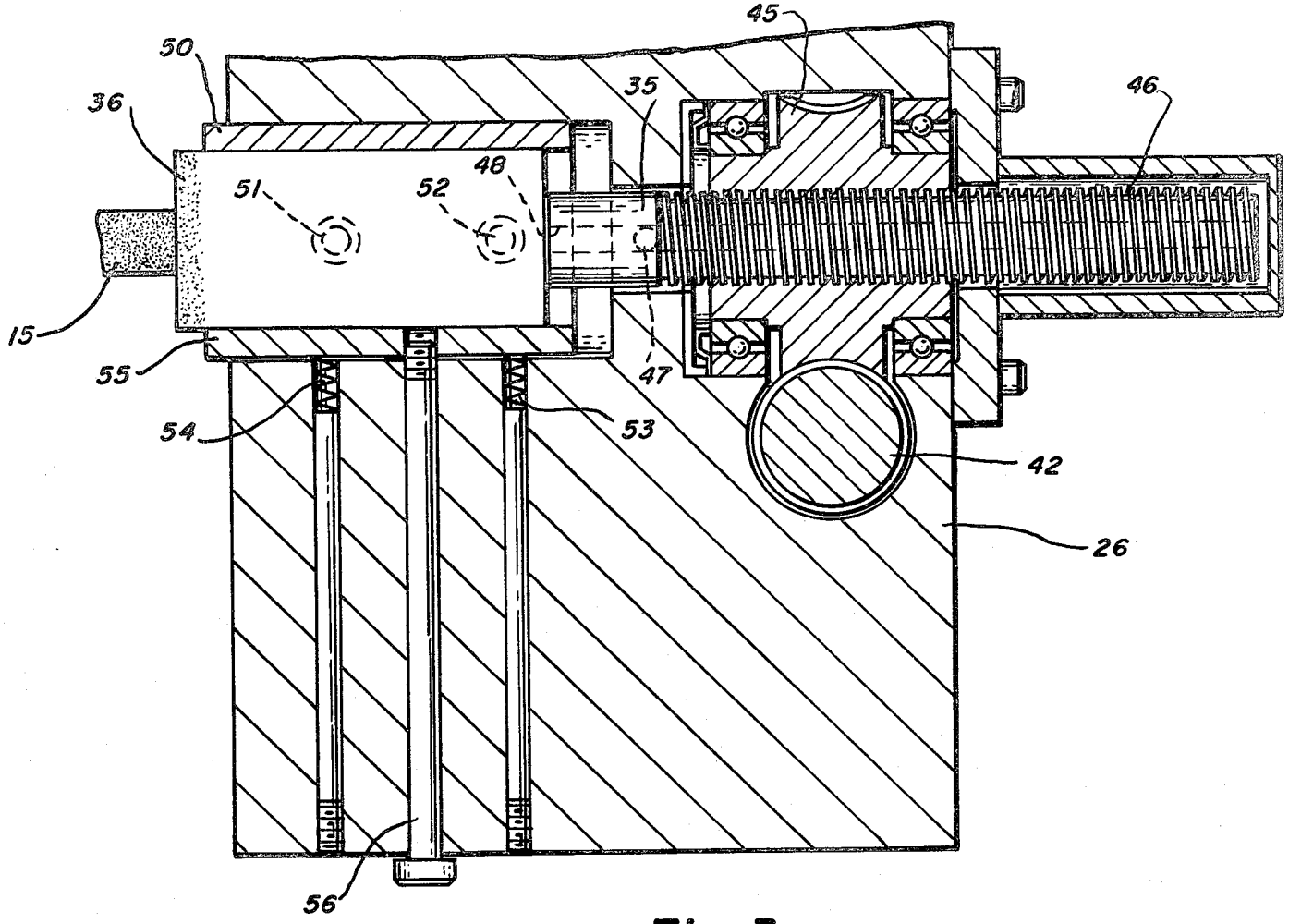
FIG. 3 is a section view of the dresser portion of the truing and dressing device shown in FIG. 1.

As best seen in FIGS. 1 and 3, the dresser base 26 also houses a dressing bar 35. The dressing bar 35 displaces an abrasive block 36 which is advanced to tangentially engage the periphery of the grinding wheel 15 under high pressure by a drive mechanism. The drive mechanism includes an electronic stepping motor 40 secured to the dresser base 26. The stepping motor 40 includes a shaft 41 which is coupled to a worm member 42 which is rotatably supported in spaced bearings 43 and 44.

The worm member 42 is in mesh with a worm gear 45 which is in threaded engagement with thread teeth 46 of the dressing bar 35. Pin 47 slidably engages keyway slot 48 of dressing bar 35 thereby preventing rotation of the dressing bar as the gear 45 acts to advance the dressing bar. The stepping motor drive mechanism provides increments of feed as small as 0.0005 of an inch to affect advancement of the dressing bar 35 to force the abrasive block 36 into the CBN grinding wheel 15 during a dressing operation.

Figure 4:
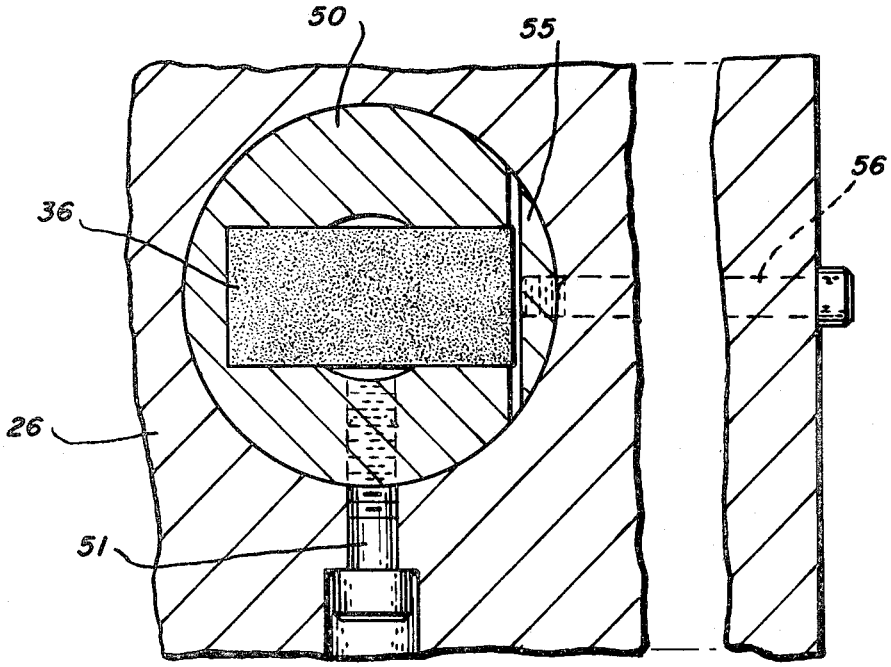
FIG. 4 is a sectional view of the abrasive block and sleeve taken along lines 4—4 of FIG. 1.

The abrasive block 36 is retained in a sleeve member 50 which is secured to the dresser base 26 by bolts 51 and 52. The abrasive block 36 which is freely slidable in a three-sided channel of the sleeve member is maintained within the slot by compression springs 53 and 54 which act on retainer 55 to forcefully urge the retainer 55 against the free side of the abrasive block. This frictional force can be overcome by the selective advancement of the dressing bar 35. The abrasive block 36 can be easily replaced by advancing bolt 56, thereby withdrawing retainer 55, as seen in FIG. 4, compressing springs 53 and 54 and releasing the block. The abrasive block which is subject to wear can thereby be easily replaced whenever excessive wear occurs.

The dressing and truing operation are simultaneously affected after a predetermined number of workpieces 13 have been ground. The dressing and truing operation is performed with the machine in a manual operating mode. The operator will traverse the work table 12 to align the dressing and truing assembly 20 with the grinding wheel 15. The wheelhead support member is advanced until the grinding wheel 15, which is rotating, is close to the truing tool 22. The dresser motor 30 is started and the truing tool 22 is rotated. The CBN dress cycle is started and the grinding wheel is advanced in increments of 0.00005 inch. The dressing bar 35 is advanced in increments of 0.00025 inch by the stepping motor 40 and the abrasive block 36 contacts the periphery of the CBN grinding wheel 15 to affect the dressing operation under high pressure. The rotary truing tool 22 penetrates the CBN grinding wheel 15 to affect the truing operation while the wheel is being dressed by the abrasive block 36. A fine layer of dull boron and matrix or bond will be removed. The abrasive block will also remove a shallow layer of the matrix or bond beyond the outer edge of the CBN grinding wheel 15. The cutting surface of the CBN grinding wheel 15 will be parallel to the axis of the workpiece 13.

The dressing bar 35 can also be advanced independently to remove any glazing from the CBN grinding wheel 15 when a normal truing and dressing cycle is not required.

Though the above describes and illustrates a dressing block 36 and sleeve member 50 whose long axes are disposed horizontally, it is obvious that the dresser could be constructed so as to orient them vertically if desired.

What is claimed is:

1. A cylindrical grinding machine truing and dressing device for refinishing the surface of a peripheral grinding wheel of a cylindrical grinder comprising support base attached to the work bed of a cylindrical grinding machine, housing means mounted to said base having means for rotatably supporting rotatable truing tool means, means for slidably housing dressing bar and abrasive block means, motor drive means to rotatively power said truing tool means, timing belt means to transmit rotative power to said truing tool means, stepping motor means to axially displace said dressing bar and abrasive block means, worm gear means for translating said stepping motor rotation into dressing bar axial displacement, said axial displacement precisely controlled to forcefully engage grinding wheel before, during and after truing operation.

2. A truing and dressing device according to claim 1 wherein said abrasive block means includes sleeve means for secondarily housing said abrasive block means, spring means for securing said abrasive block means to said sleeve means for ease of removal.

3. A truing and dressing device according to claim 1 wherein said abrasive block means comprises inexpensive, disposable and easily replaced modules.

4. A truing and dressing device according to claim 1 wherein said truing tool means comprises impregnated diamond means for restoring said grinding wheel surface to its running truth.

5. A dressing bar assembly for a cylindrical grinding machine comprising a base including a bore, a sleeve member matingly inserted into said base bore, said sleeve member being axially truncated and having an axially extending slot opening along the truncated surface, means for securing said sleeve member at a predetermined axial and radial location, an abrasive block located within said slot and projecting beyond said slot opening, retainer means located with said sleeve member within said base bore and including an abrasive block engaging surface, means for maintaining said retaining means at a predetermined axial location within said bore, means for forcefully urging said retainer means against the axially exposed portion of said abrasive block to frictionally hold said abrasive block in its axial position, means for retracting said retainer to free said abrasive block, and means for overcoming said frictional engagement and axially advancing said abrasive block.

* * * * *